US010662623B2

(12) United States Patent
Fukuda et al.

(10) Patent No.: US 10,662,623 B2
(45) Date of Patent: May 26, 2020

(54) HYDRAULIC SYSTEM FOR WORKING MACHINE

(71) Applicant: KUBOTA CORPORATION, Osaka (JP)

(72) Inventors: Yuji Fukuda, Osaka (JP); Keigo Honda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 15/854,116

(22) Filed: Dec. 26, 2017

(65) Prior Publication Data

US 2018/0274209 A1 Sep. 27, 2018

(30) Foreign Application Priority Data

Mar. 22, 2017 (JP) ..... 2017-55921

(51) Int. Cl.
*E02F 9/22* (2006.01)
*E02F 3/34* (2006.01)
(Continued)

(52) U.S. Cl.
CPC ..... *E02F 9/2267* (2013.01); *E02F 3/3414* (2013.01); *E02F 9/2203* (2013.01); *E02F 9/2221* (2013.01); *E02F 9/2285* (2013.01); *E02F 9/2292* (2013.01); *F15B 7/003* (2013.01); *F15B 11/0426* (2013.01); *F15B 13/021* (2013.01); *F15B 13/0407* (2013.01); *F15B 15/28* (2013.01); *F15B 2211/20576* (2013.01); *F15B 2211/30565* (2013.01); *F15B 2211/30595* (2013.01); *F15B 2211/329* (2013.01); *F15B 2211/41572* (2013.01); *F15B 2211/428* (2013.01); *F15B 2211/6652* (2013.01);
(Continued)

(58) Field of Classification Search
CPC .... F15B 7/003; F15B 13/021; F15B 13/0407; F15B 11/0426; F15B 15/28; E02F 9/2267; E02F 9/2285; E02F 9/2203; E02F 9/2292; E02F 9/2221; E02F 3/3414
See application file for complete search history.

(56) References Cited

FOREIGN PATENT DOCUMENTS

JP 60-95272 6/1985
JP 62-24080 2/1987
(Continued)

*Primary Examiner* — Abiy Teka
(74) *Attorney, Agent, or Firm* — Greenblum & Bernstein, P.L.C.

(57) ABSTRACT

A hydraulic system includes a hydraulic actuator to be operated by an operation fluid, a first hydraulic pump to output the operation fluid, a second hydraulic pump to output the operation fluid, a control valve to which the operation fluid outputted from the first hydraulic pump is supplied, the control valve being configured to control the operation fluid that is to be supplied to the hydraulic actuator, a first fluid tube connecting the control valve to the hydraulic actuator, a second fluid tube to which the operation fluid outputted from the second hydraulic pump is supplied, the second fluid tube being connected to the first fluid tube, and a first switching valve disposed on the second fluid tube. The spool includes a communicating fluid passage being configured to supply the operation fluid to the first inner fluid passage, the operation fluid being received by the pressure-receiving port.

6 Claims, 19 Drawing Sheets

(51) Int. Cl.

| | |
|---|---|
| ***F15B 13/02*** | (2006.01) |
| ***F15B 7/00*** | (2006.01) |
| ***F15B 15/28*** | (2006.01) |
| ***F15B 13/04*** | (2006.01) |
| ***F15B 11/042*** | (2006.01) |

(52) U.S. Cl.
CPC ..... *F15B 2211/6654* (2013.01); *F15B 2211/7142* (2013.01)

(56) References Cited

FOREIGN PATENT DOCUMENTS

| | | | | |
|---|---|---|---|---|
| JP | 2-31006 | | 2/1990 | |
| JP | 2002-536588 | | 10/2002 | |
| JP | P2006-283852 | | 10/2006 | |
| JP | 2011-231468 | | 11/2011 | |
| JP | P2016-125559 | A | 7/2016 | |
| WO | WO-2016051815 | A1 * | 4/2016 | ..... F16H 61/4035 |
| WO | 2016/051815 | | 4/2017 | |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2017-55921, filed Mar. 22, 2017. The content of this application is incorporated herein by reference in their entirety.

BACKGROUND OF THE INVENTION

Field of the Invention

The present invention relates to a hydraulic system for a working machine such as a skid steer loader, a compact track loader, and the like.

Discussion of the Background

As for a working machine such as a skid steer loader and a compact track loader, a working machine is previously known, the working machine including a hydraulic system (refer to Japanese Unexamined Patent Application Publication No. 2011-231468). The hydraulic system has a first hydraulic pump and a second hydraulic pump, the first hydraulic pump being configured to supply an operation fluid to a hydraulic actuator, the second hydraulic pump being configured to increase a flow rate of the operation fluid that is to be supplied to the hydraulic actuator.

According to Japanese Unexamined Patent Application Publication No. 2011-231468, an increasing fluid tube to supply the operation fluid outputted from the second hydraulic pump is connected to an operation fluid supply tube of the operation fluid, the operation fluid supply tube extending from the first hydraulic pump to the hydraulic actuator, thereby increasing the operation fluid flowing into the hydraulic actuator. In particular, a high flow valve is configured to be switched between a non-increasing position and an increasing position by the pilot pressure. When the high flow valve is switched to the increasing position, the operation fluid outputted from the second hydraulic pump is supplied to the increasing fluid tube, and thus the operation fluid to be supplied to the hydraulic actuator is increased.

However, according to Japanese Unexamined Patent Application Publication No. 2011-231468, when the high flow valve is switched to the increasing position, the flow rate of a main fluid tube is rapidly increased, and the rapidly-increasing may generate a surge pressure.

According to International Publication No. 2016/051815, a throttling portion is disposed on a pilot fluid tube that is configured to connect the high flow valve to a high flow switching valve configured to switch the high flow valve, and a bleeding circuit is disposed on the pilot fluid tube, the bleeding circuit being configured to discharge the operation fluid, thereby reducing the surge pressure generated when the high flow valve is in the increasing position.

SUMMARY OF THE INVENTION

A hydraulic system for a working machine of the present invention, includes a hydraulic actuator configured to be operated by an operation fluid, a first hydraulic pump configured to output the operation fluid, a second hydraulic pump configured to output the operation fluid, a control valve to which the operation fluid outputted from the first hydraulic pump is supplied, the control valve being configured to control the operation fluid that is to be supplied to the hydraulic actuator, a first fluid tube connecting the control valve to the hydraulic actuator, a second fluid tube to which the operation fluid outputted from the second hydraulic pump is supplied, the second fluid tube being connected to the first fluid tube, and a first switching valve disposed on the second fluid tube. The first switching valve includes a pressure-receiving port configured to receive a pressure of the operation fluid, a first inner fluid passage configured to output the operation fluid, and a spool configured to move between a first position and a second position. The first position allows the operation fluid not to be supplied to the first fluid tube. The second position allows the operation fluid to be supplied to the first fluid tube due to the operation fluid applied to the pressure-receiving port. The spool includes a communicating fluid passage being configured to supply the operation fluid to the first inner fluid passage, the operation fluid being received by the pressure-receiving port.

Another hydraulic system for a working machine of the present invention, includes a hydraulic actuator configured to be operated by an operation fluid, a first hydraulic pump configured to output the operation fluid, a second hydraulic pump configured to output the operation fluid, a control valve to which the operation fluid outputted from the first hydraulic pump is supplied, the control valve being configured to control the operation fluid that is to be supplied to the hydraulic actuator, a first fluid tube connecting the control valve to the hydraulic actuator, a second fluid tube to which the operation fluid outputted from the second hydraulic pump is supplied, the second fluid tube being connected to the first fluid tube, a first switching valve disposed on the second fluid tube. The first switching valve includes a pressure-receiving port configured to receive a pressure of the operation fluid, and a spool configured to move between a first position and a second position. The first position allows the operation fluid not to be supplied to the first fluid tube. The hydraulic system further includes a first pilot fluid tube connected to the pressure-receiving port of the first switching valve, and a second switching valve including a first port to which the operation is supplied, a second port connected to the pilot fluid tube, an outputting port configured to output the operation fluid, a spool configured to move between a first position and a second position, a fifth inner fluid passage configured to connect the first port to the second port when the spool is in the first position, and a sixth inner fluid passage connected to the fifth inner fluid passage and connected to the outputting port.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
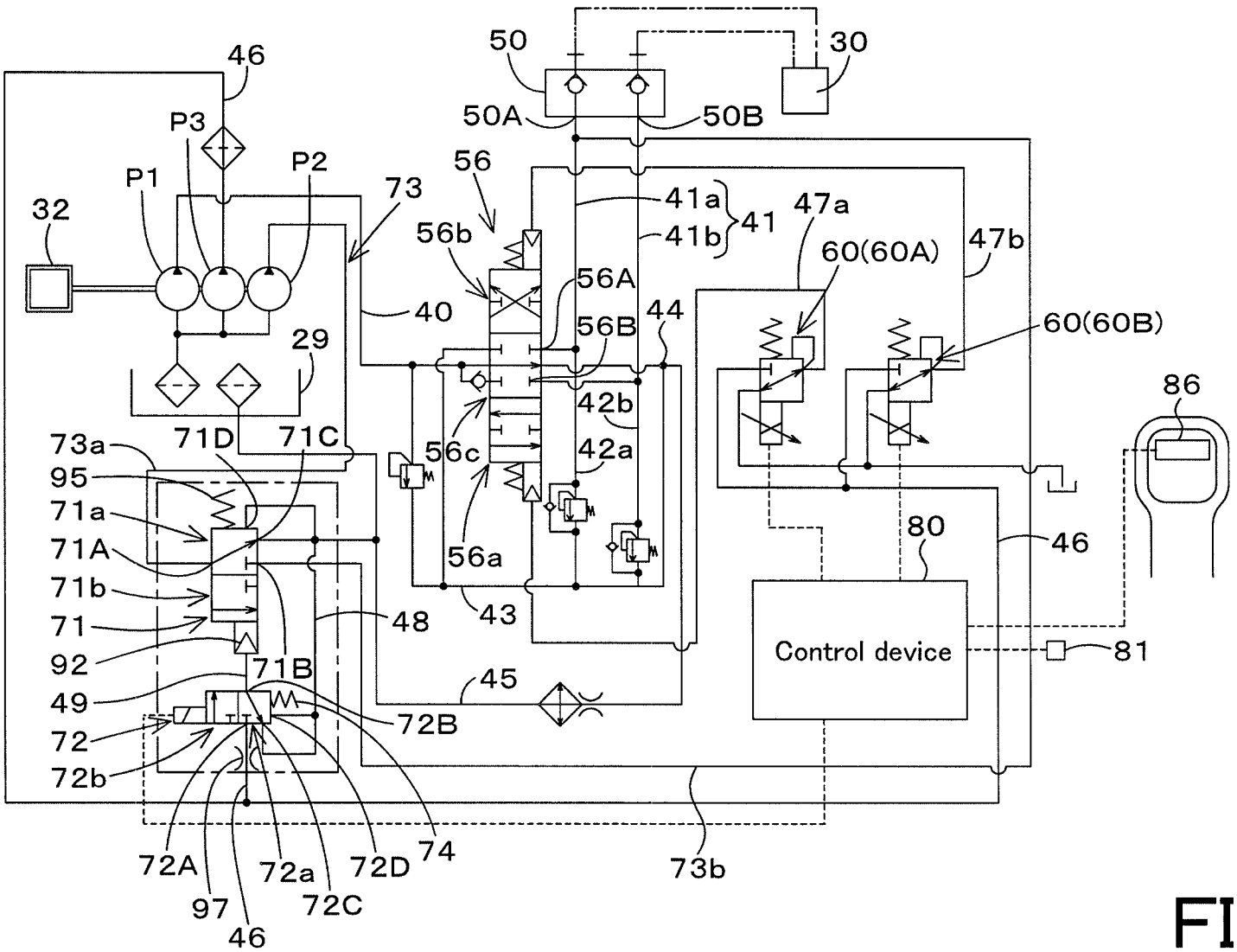
FIG. 1 is a view illustrating a hydraulic system for a working machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, the embodiments of the present invention, a hydraulic system for a working machine and the working machine having the hydraulic system, will be described below.

First Embodiment

A working machine will be explained below.

Figure 6:
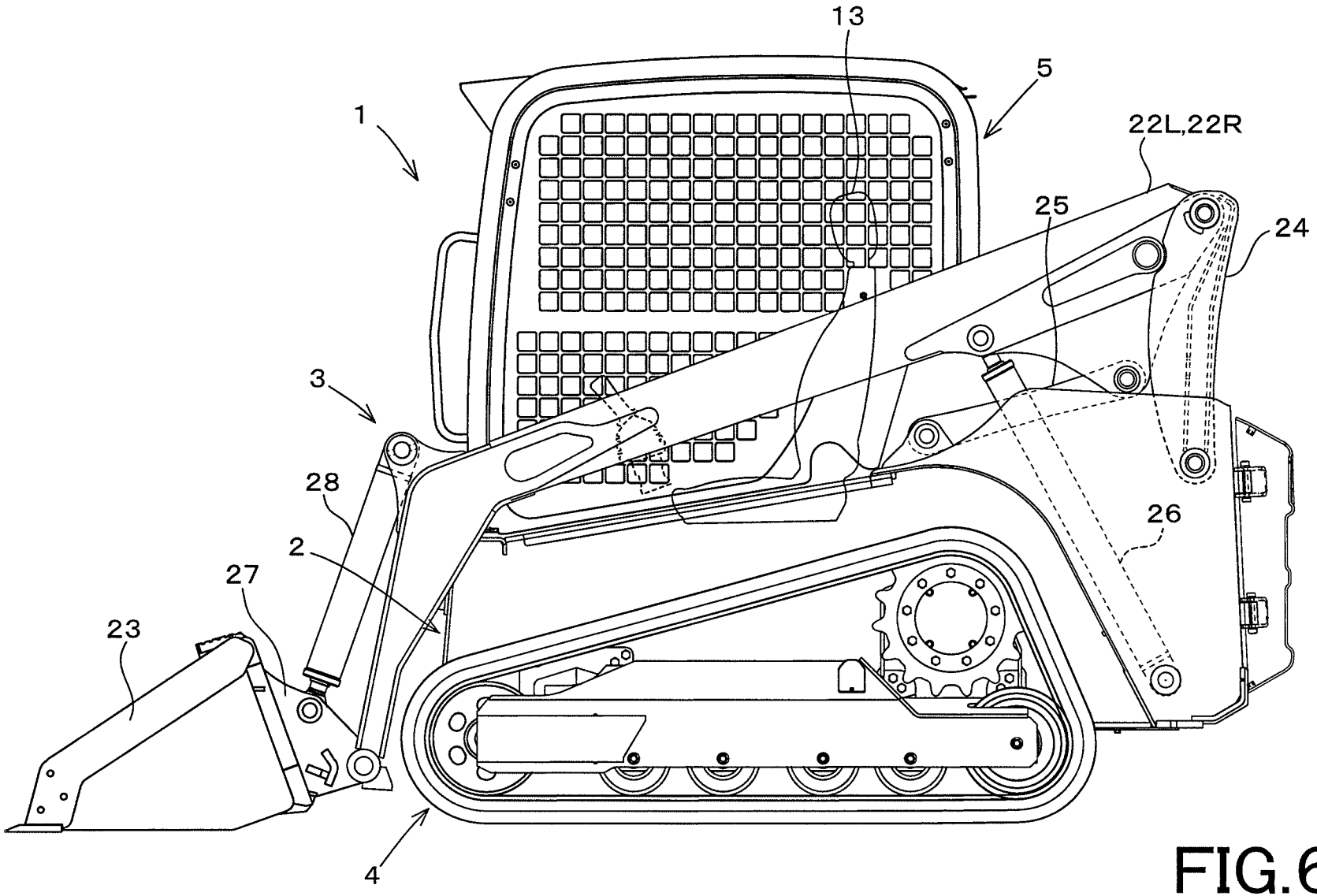
FIG. 6 is a side view illustrating a track loader as an example of the working machine according to the embodiments.
Figure 7:
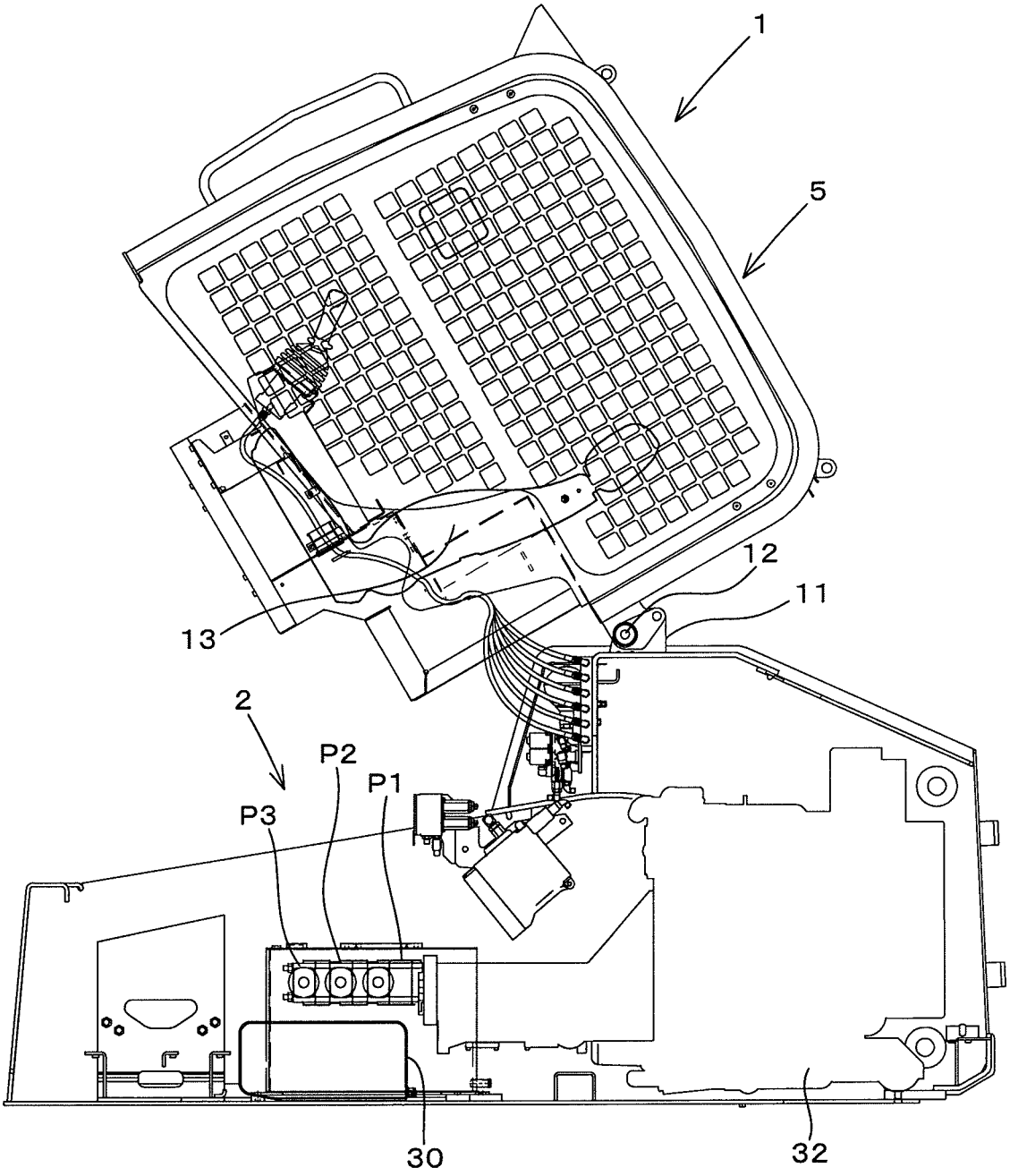
FIG. 7 is a side view illustrating a part of the track loader lifting up a cabin according to the embodiments.

As shown in FIG. 6 and FIG. 7, a working machine 1 according to embodiments of the present invention includes a machine body (a vehicle body) 2, an operation device 3 attached to the machine body 2, and a travel device 4 supporting the machine body 2. FIG. 6 and FIG. 7 show a track loader as an example of the working machine 1. However, the working machine 1 according to the embodiments is not limited to the track loader. The working machine 1 may be other types of the working machine such as a tractor, a Skid Steer Loader (SSL), a Compact Track Loader (CTL), and a backhoe.

Hereinafter, in explanations of all the embodiments of the present invention, a forward direction (a left side in FIG. 6) corresponds to a front side of an operator seated on an operator seat of the working machine 1, a backward direction (a right side in FIG. 6) corresponds to a back side of the operator, a leftward direction (a front surface side of the sheet of FIG. 6) corresponds to a left side of the operator, and a rightward direction (a back surface side of the sheet of FIG. 6) corresponds to a right side of the operator.

A cabin 5 is mounted on a front portion and an upper portion of the machine body 2. A rear portion of the cabin 5 is supported by a supporting bracket 11 of the machine body 2, and is configured to be swung about a supporting shaft 12. A front portion of the cabin 5 is configured to be mounted on a the front portion of the machine body 2. A prime mover 32 is installed on a rear portion of the machine body 2. The prime mover 32 is constituted of an electric motor, an engine, or the like. In the embodiment, the prime mover 32 is constituted of the engine.

An operator 13 is disposed inside the cabin 5. The travel device 4 is constituted of a crawler type travel device. The travel device 4 is disposed under the machine body 2 and on the left side of the machine body 2. Another travel device 4 is disposed under the machine body 2 and on the right side of the machine body 2. Each of the travel devices 4 is configured to be driven by a driving force of a travel motor such as a hydraulic-driving wheel motor.

The operation device 3 includes a boom 22L, a boom 22R, and a working tool 11 (for example, a bucket) attached to tip ends of the booms 22L and 22R. The boom 22L is arranged on the left side of the machine body 2. The boom 22R is arranged on the right side of the machine body 2. The boom 22L and the boom 22R are connected by a connecting member to each other. The boom 22L and the boom 22R are supported by the first lift link 24 and the second lift link 25.

A lift cylinder 26 constituted of a double-acting hydraulic cylinder is disposed between a rear lower portion of the machine body 2 and a base portion side of the boom 22L. Another lift cylinder 26 constituted of a double-acting hydraulic cylinder is disposed between a rear lower portion of the machine body 2 and a base portion side of the boom 22R. The lift cylinder 26 and the other lift cylinder 26 are simultaneously stretched and shortened to swing the boom 22L and the boom 22R upward and downward. An attachment bracket 27 is supported on the tip end side of each of the boom 22L and the boom 22R, and is configured to be turned. A back surface side of the bucket 23 is attached to the attachment bracket 27.

A tilt cylinder 28 constituted of a double-acting hydraulic cylinder is installed between the attachment bracket 27 and an intermediate portion of the tip end side of each of the boom 22L and the boom 22R. The tilt cylinder 28 is stretched and shortened, and thereby the bucket 23 performs a swinging operation (the shoveling operation and the dumping operation).

The bucket 23 is configured to be attached to and detached from the attachment bracket 27. Not only the bucket 11, other working tools can be attached to the tip ends of the boom 22R and the boom 22L. The following attachments (spare attachments) are exemplified as the other working tools; for example, a hydraulic crusher, a hydraulic breaker, an angle broom, an earth auger, a pallet fork, a sweeper, a mower, a snow blower, and the like.

In addition, a connecting device 50 is disposed on the tip end of each of the boom 22L and the boom 22R, the connecting device 50 configured to be connected to the hydraulic actuator (the hydraulic cylinder, the hydraulic motor, and the like) 30 that is disposed on the auxiliary attachment. For convenience of the explanation, the hydraulic actuator disposed on the auxiliary attachment will be referred to as an auxiliary actuator below.

Next, the hydraulic system for the working machine 1 will be described below.

FIG. 1 shows the hydraulic system of the working machine 1. As shown in FIG. 1, the hydraulic system for the working machine 1 includes a first hydraulic pump P1, a second hydraulic pump P2, a third hydraulic pump P3, a control valve 56, and an operation valve 60. Each of the first hydraulic pump P1, the second hydraulic pump P2, and the third hydraulic pump P3 is constituted of a constant displacement type gear pump that is configured to be driven by the motive power of the prime mover 32, and outputs the operation fluid.

The operation fluid outputted from the first hydraulic pump P1 is used to drive the lift cylinder 26, the tilt cylinder 28, and the hydraulic actuator of the attachment attached to the tip end side of the boom 22. The operation fluid outputted from the second hydraulic pump P2 is used to increase the flow rate of the operation fluid supplied to the auxiliary actuator. The operation fluid outputted from the third hydraulic pump P3 is mainly used as an operation fluid for signal or control. Hereinafter, the operation fluid for signal or control may be referred to as a pilot fluid.

The first hydraulic pump P1 and the control valve 56 are connected each other by an outputting fluid tube 40. The control valve 56 is constituted of a control valve configured to control the hydraulic actuator that is disposed on the working machine 1. In the embodiment, the operating valve 56 controls the auxiliary hydraulic actuator configured to activate the auxiliary attachment. It should be noted that the control valve 56 is not limited to a control valve configured to control the auxiliary hydraulic actuator.

The control valve 56 is constituted of a direct-acting three-position switching valve having a spool operated by the pilot fluid. The direct-acting three-position switching valve is configured to be switched by a pilot pressure of the pilot fluid between a first position 56*a*, a second position 56*b*, and a neutral position 56*c*. The control valve 56 and the connecting device 50 are connected each other by a first fluid tube 41.

The first fluid tube 41 includes a first supplying-outputting fluid tube 41*a* and a second supplying-outputting fluid tube 41*b*. The first supplying-outputting fluid tube 41*a* connects the first port 56A of the control valve 56 to the first port 50A of the connecting device 50. The second supplying-outputting fluid tube 41*b* connects the second port 56B of the control valve 56 to the second port 50B of the connecting device 50.

An outputting fluid tube 42*a* is connected to the first supplying-outputting fluid tube 41*a*, and an outputting fluid tube 42*b* is connected to the second supplying-outputting fluid tube 41*b*. The outputting fluid tube 42*a* and the outputting fluid tube 42*b* are connected to a bypass fluid tube 43 in the discharge fluid tube 40, the bypass fluid tube 43 connecting the upstream side of the control valve 56 and the downstream side of the control valve 56 to each other. An outputting fluid tube 45 configured to output the operation fluid is connected to a connecting portion 44 in the discharge fluid tube 40, the connecting portion 44 being configured to connect the downstream side of the control valve 56 and the bypass fluid tube 43 to each other.

The control valve 56 is operated by a plurality of operation valves 60. The plurality of operation valves 60 include a first proportional valve 60A and a second proportional valve 60B. Each of the first proportional valve 60A and the second proportional valve 60B is constituted of a solenoid valve (an electromagnetic valve) whose degrees of an opening aperture can be changed by magnetic excitation or the like. The first proportional valve 60A and the second proportional valve 60B are connected to the second pilot fluid tube 46 that is connected to the third hydraulic pump P3. A pressure-receiving portion (also referred to as a pressure-receiving port) of the control valve 56 and the proportional valve 60 (the first proportional valve 60A and the second proportional valve 60B) are connected each other by fluid tubes 47*a* and 47*b*. The proportional valve 60 (the first proportional valve 60A and the second proportional valve 60B) is controlled by the control device 80.

A switch 86 is connected to the control device 80. The switch 86 is one of operation control members. The operation amount (the operation extent) such as the sliding amount (the sliding extent) and the swinging amount (the swinging extent) of the switch 86 is inputted to the control device 80. The switch 86 is, for example, constituted of a seesaw type switch configured to be swung, a slide type switch configured to be slid, a push type switch configured to be pushed, or the like. When the switch 86 is operated, the control device 80 outputs a control signal to magnetically excite the first proportional valve 60A or the second proportional valve 60B in accordance with the operation direction and the operation amount of the switch 86.

In this manner, the degree of opening aperture of the first proportional valve 60A or the second proportional valve 60B is set, and the control valve 56 is switched to the first position 56*a* or the second position 56*b*. Thus, the switch 86 is operated, thereby operating the auxiliary actuator of the auxiliary attachment.

Meanwhile, according to the hydraulic system for the working machine 1, it is possible to increase the hydraulic fluid that is to be supplied to the auxiliary actuator. The increasing of the hydraulic fluid supplied to the auxiliary actuator will be described below in detail.

As shown in FIG. 1, the hydraulic system for the working machine 1 includes a first switching valve 71, a second switching valve 72, and a second fluid tube 73. The second fluid tube 73 is constituted of a fluid tube configured to connect the second hydraulic pump P2 and the first fluid tube 41 to each other. That is, the second fluid tube 73 is constituted of a fluid tube that is connected to the first fluid tube 41 and supplies the operation fluid to the first fluid tube 41, the operation fluid being outputted from the second hydraulic pump P2.

More specifically, the second fluid tube 73 has a first increasing fluid tube 73*a* and a second increasing fluid tube 73*b*. The first increasing fluid tube 73*a* is configured to connect the second hydraulic pump P2 and the first switching valve 71 to each other. The second increasing fluid tube 73*b* connects the first switching valve 71 and the first supplying-outputting fluid tube 41*a* of the first fluid tube 41 to each other. Meanwhile, the second increasing fluid tube 73*b* is connected to the first supplying-outputting fluid tube 41*a* of the first fluid tube 41. However, instead of that, the second increasing fluid tube 73*b* may be connected to the second supplying-outputting fluid tube 41*b*.

The first switching valve 71 has a first port 71A, a second port 71B, a third port 71C, and a fourth port 71D. The first increasing fluid tube 73*a* is connected to the first port 71A, and the second increasing fluid passage 73*b* is connected to the second port 71B. An outputting fluid tube 45 is connected to the third port 71C. The fourth port 71D is connected to connect an outputting fluid tube 48 that connects the first switching valve 71 and the second switching valve 72 to each other and is connected to the outputting fluid tube 45. Each of the third port 71C and the fourth port 71D is constituted of an outputting port configured to output the operation fluid to the outside.

The first switching valve 71 is a two-position switching valve configured to be switched between the first position 71*a* and the second position 71*b*. When the first switching valve 71 is in the first position 71*a*, the first port 71A and the third port 71C communicate with each other, and thereby the hydraulic fluid in the second fluid tube 73 is outputted to the hydraulic fluid tank 29 through the outputting fluid tube 45.

When the first switching valve 71 is in the second position 71*b*, the first port 71A and the second port 71B communicate with each other, and thereby the operation fluid in the first increasing fluid tube 73*a* is introduced into the second increasing fluid tube 73*b*. That is, the first switching valve 71 is configured to be switched between a first position 71*a* and a second position 71*b*. The first position 71*a* allows the operation fluid not to be supplied to the first fluid tube 41, and the second position 71*b* allows the operation fluid to be supplied to the first fluid tube 41. In other words, the first position 71*a* block the operation fluid from being supplied to the first fluid tube 41, and the second position 71*b* supplies the operation fluid to the first fluid tube 41.

The second switching valve 72 is constituted of a valve configured to switch the first switching valve 71 between the first position 71*a* and the second position 71*b*. The second switching valve 72 has a first port 72A, a second port 72B, a third port 72C, and a fourth port 72D. A second pilot fluid tube 46 is connected to the first port 72A. And, the second port 72B is connected to the first pilot fluid tube 49 that is connected to a pressure-receiving portion (also referred to as a pressure-receiving port) 92 of the first switching valve 71. The third port 72C and the fourth port 72D are connected to the outputting fluid tube 48. Each of the third port 72C and the fourth port 72D serves as an outputting port configured to output the operation fluid to the outside.

A throttling portion (throttle) 97 is disposed on the second pilot fluid tube 46 in the vicinity of the first port 72A of the second switching valve 72, the throttling portion (throttle) 97 being configured to reduce the flow rate of the pilot fluid.

The second switching valve 72 is constituted of a two-position switching valve configured to be switched between the first position 72*a* and the second position 72*b*. The second switching valve 72 has a spool (not shown in the drawings) and is switched between the first position 72*a* and the second position 72*b* by the movement of the spool (a second spool). The spool is pushed toward the first position 72*a* by a biasing member 74 such as a spring.

The second switching valve 72 is switched in accordance with a control signal outputted from the control device 80. A switch 81, for example, is connected to the control device 80, the switch 81 being configured to be turned ON/OFF. The switch 81 is disposed in the vicinity of the operator seat 13 and can be operated, for example, by an operator. When the switch 81 is turned ON, the control device 80 outputs a control signal for magnetically exciting (magnetizing) the solenoid of the second switching valve 72, and thereby switches the second switching valve 72 to the second position 72*b*. When the switch 81 is turned OFF, the control device 80 outputs a control signal for demagnetizing the solenoid of the second switching valve 72, and thereby switches the second switching valve 72 to the first position 72*a*.

When the second switching valve 72 is in the first position 72*a*, the second port 72B of the second switching valve 72 communicates with the third port 72C, and thereby the operation fluid in the first pilot fluid tube 49 is released to the outputting fluid tube 48. As the result, the pilot pressure of the pilot fluid is not applied to the pressure-receiving portion 92 of the first switching valve 71, and thus the first switching valve 71 is switched to the first position 71*a*.

When the second switching valve 72 is in the second position 72*b*, the first port 72A of the second switching valve 72 communicates with the second port 72B, and thereby the operation fluid in the second pilot fluid tube 46 flows to the first pilot fluid tube 49. As the result, the pilot pressure is applied to the pressure-receiving portion 92 of the first switching valve 71, and thus the first switching valve 71 is switched to the second position 71*b*.

Figure 2:
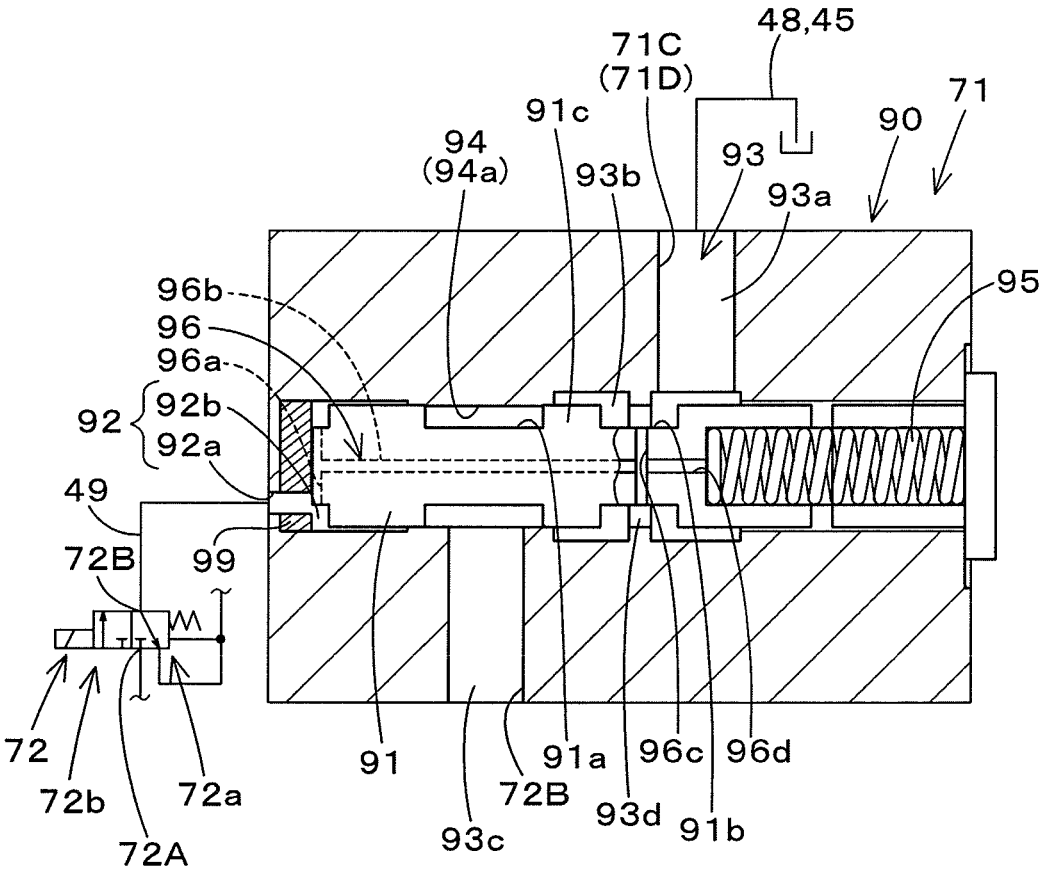
FIG. 2 is a view illustrating details of a first operation valve according to the first embodiment.

FIG. 2 is a view showing the inside of the first switching valve 71. The first switching valve 71 includes a main body 90, a spool (a first spool) 91, and a pressure-receiving portion 92.

The main body 90 is made by the casting, formed of a resin, or the like. A fluid passage (an inner fluid passage) 93 through which the hydraulic fluid flows is formed in the main body 90. The inner fluid passage 93 includes a first inner fluid passage 93*a*, a second inner fluid passage 93*b*, a third inner fluid passage 93*c*, and a fourth inner fluid passage 93*d*.

The first inner fluid passage 93*a* is constituted of an fluid tube formed in the main body 90, the fluid tube being configured to output the hydraulic fluid in the main body 90 to the outside of the main body 90. The first inner fluid passage 93*a* communicates with the third port 71C or the fourth port 71D. That is, the first inner fluid passage 93*a* is connected to a port through which the operation fluid is outputted.

The second inner fluid passage 93*b* is constituted of an fluid tube formed in the main body 90, that is, a fluid tube into which the operation fluid of the first increasing fluid tube 73*a* is introduced. The second inner fluid passage 93*b* communicates with the first port 71A.

The third inner fluid passage 93*c* is constituted of an fluid tube formed in the main body 90, that is, a fluid tube configured to supply the operation fluid to the second increasing fluid tube 73*b*, the operation fluid being introduced from the first increasing fluid tube 73*a*. The third inner fluid passage 93*c* communicates with the second port 71B.

The fourth inner fluid passage 93*d* is constituted of an fluid tube formed in the main body 90, that is, a fluid tube connected to the first inner fluid passage 93*a* and the second inner fluid passage 93*b* to communicate with the first inner fluid passage 93*a* and the second inner fluid passage 93*b*.

A through hole 94 having a straight shape is formed inside the main body 90. The first internal fluid tube 93*a*, the second internal fluid tube 93*b*, and the third internal fluid tube 93*c* reach a wall portion 94*a* constituting the through hole 94, the wall portion 94*a* having an annular shape. The through hole 94 and the fourth internal fluid tube 93*d* are shared with each other. Meanwhile, the first internal fluid tube 93*a*, the second internal fluid tube 93*b*, and the third internal fluid tube 93*c* are orthogonal to a direction of extension of the wall section 94*a* that constitutes the through hole 94.

The pressure-receiving portion 92 is a portion configured to receive a pressure of the operation fluid, and includes a port 92*a* into which the operation fluid of the first pilot hydraulic passage 49 is introduced and a pressure-receiving chamber 92*b* into which the operation fluid introduced from the port 92*a* flows.

In this embodiment, the pressure-receiving chamber 92*b* communicates with the through hole 94. In addition, the pressure-receiving chamber 92*b* is provided with a stopper 99 configured to restrict the movement of the spool 91 in the manner that the end surface of the spool 91 contacts to the stopper 99. In this embodiment, a hole communicating with the port 92 is formed in the stopper 99.

The spool 91 is configured to be moved inside the main body 90 by the operation fluid introduced into the pressure-receiving portion 92. The connecting destination of the first internal fluid tube 93*a*, the second internal fluid tube 93*b*, and the third internal fluid tube 93*c* are changed by the movement of the spool 91.

The spool 91 is configured to move to a first position 71*a* and a second position 71*b*, the first position 71*a* allowing the operation fluid not to be supplied to the first fluid tube 41, the second position 71*b* allowing the hydraulic fluid to be supplied to the first fluid tube 41. In other words, the first position 71*a* block the operation fluid from being supplied to the first fluid tube 41, and the second position 71*b* supplies the operation fluid to the first fluid tube 41. In addition, when the spool 91 is in the first position 71*a*, the spool 91 opens the fourth inner fluid passage 93*d* and, when the spool 91 is in the second position 71*b*, the spool 91 closes the fourth inner fluid passage 93*d*.

Hereinafter, the spool 91 will be described below in detail.

Figure 3A:
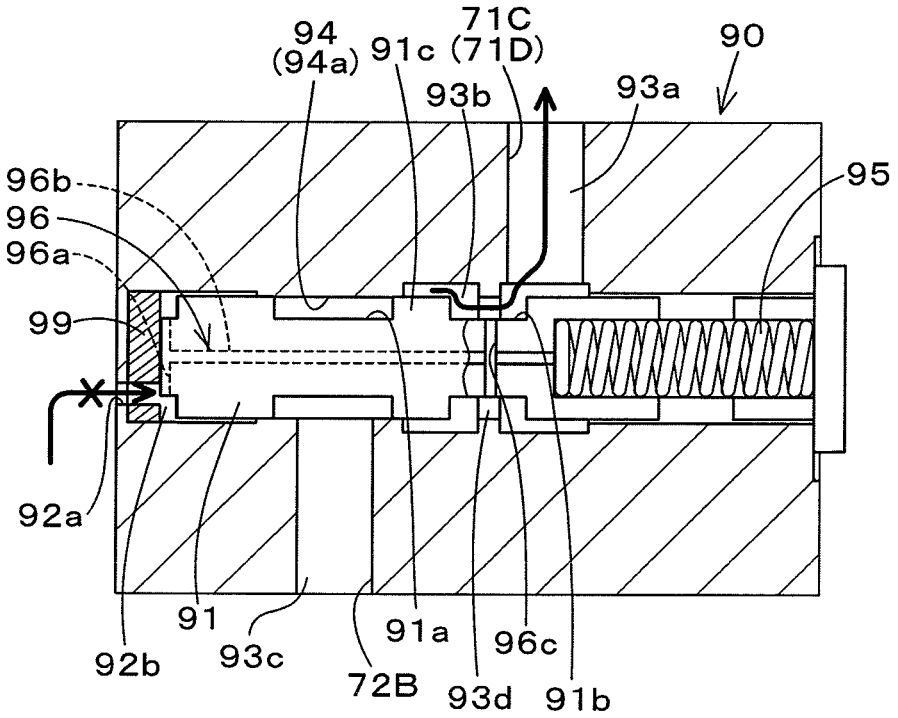
FIG. 3A is a view illustrating a state where the first operation valve (a spool) is in a first position according to the first embodiment.

The spool 91 is formed in a cylindrical shape. The spool 91 having a cylindrical shape is inserted into the through hole 94 formed inside the main body 90. As shown in FIG. 3A, when the hydraulic fluid is not applied to the pressure-receiving chamber 92*b*, the spool 91 is pushed by a biasing member (for example, a spring) 95 disposed on a side (for example, the right side) opposite to one end side (for example, the left side) of the spool 91, and thereby the spool 91 is pushed toward the one end side.

Figure 3B:
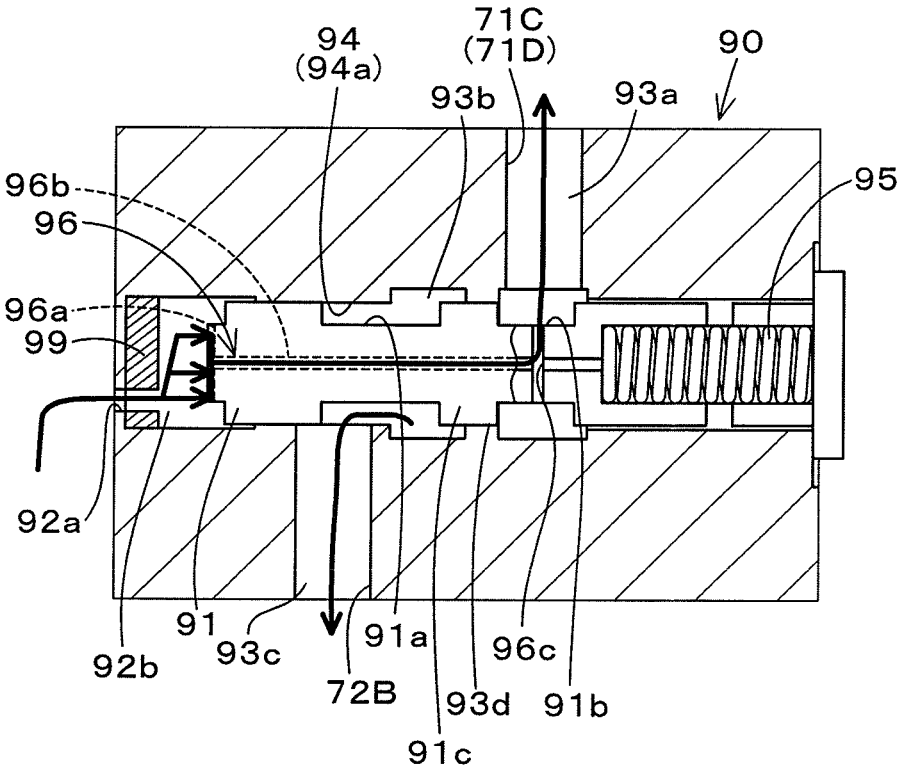
FIG. 3B is a view illustrating a state where the first operation valve (a spool) is in a second position according to the first embodiment.

In this manner, the one end of the spool 91 contacts to the stopper 99, and thereby the spool 91 is held at the first position 71*a*. As shown in FIG. 3B, when the operation fluid is applied to the pressure-receiving chamber 92*b*, the spool 91 is pushed toward the opposite side (the spring 95 side) by the operation fluid in the pressure-receiving chamber 92*b*, and thereby the spool 91 moves away from the stopper 99 toward the right side. When the pressure of the operation fluid in the pressure-receiving chamber 92*b* is equal to or higher than a predetermined pressure, the spool 91 is in the second position 71*b* and thus compresses the spring 95 most.

The spool 91 has a first connecting portion 91*a* and a second connecting portion 91*b*. The first connecting portion 91*a* is configured to connect the second inner fluid passage 93*b* and the third inner fluid passage 93*c* to each other. The second connecting portion 91*b* is configured to connect the first inner fluid passage 93*a*, the second inner fluid passage 93*b*, and the fourth inner fluid passage 93*d* to each other.

In particular, the first connecting portion 91*a* and the second connecting portion 91*b* are portions formed by annularly recessing the outer circumference surfaces of the spool 91. As shown in FIG. 3B, by moving the spool 91, the first connecting portion 91*a* is overlapped with (corresponds to) both the second inner fluid passage 93*b* and the third inner fluid passage 93*c*. That is, when the first switching valve 71 (the spool 91) is in the second position 71*b*, the first connecting portion 91*a* is connected to the second inner fluid passage 93*b* and to the third inner fluid passage 93*c*.

As shown in FIG. 3A, by moving the spool, the first connecting portion 91*a* is overlapped with (corresponds to) only the third inner fluid passage 93*c*. That is, when the first switching valve 71 is in the first position 71*a*, the first connecting portion 91*a* blocks the connection (communicating) between the second inner fluid passage 93*b* and the third inner fluid passage 93*c*.

In addition, as shown in FIG. 3A, by moving the spool 91, the second connecting portion 91*b* is overlapped with (corresponds to) each of the first inner fluid passage 93*a*, the second inner fluid passage 93*b*, and the fourth inner fluid passage 93*d*. That is, when the first switching valve 71 is in the first position 71*a*, the second connecting portion 91*b* is connected to the first inner fluid passage 93*a*, the second inner fluid passage 93*b*, and the fourth inner fluid passage 93*d*.

As shown in FIG. 3B, by moving the spool 91, the second connecting portion 91*b* is not overlapped with the second inner fluid passage 93*b*. That is, when the first switching valve 71 is in the second position 71*b*, the second connecting portion 91*b* blocks the connection (communicating) between the first inner fluid passage 93*a* and the second inner fluid passage 93*b*.

In other words, in the spool 91, the closing portion 91*c* having a convex shape is overlapped with (corresponds to) the fourth inner fluid passage 93*d*, the closing portion 91*c* being disposed between the first connecting portion 91*a* and the second connecting portion 91*b*, and thereby the connection (communicating) between the first inner fluid passage 93*a* and the second inner fluid passage 93*b* is blocked.

Meanwhile, the spool 91 has a communicating fluid passage 96. The communicating fluid passage 96 is constituted of a fluid tube allowing the operation fluid received by the pressure-receiving portion 92 (the pressure-receiving chamber 92*b*) to be supplied to the first inner fluid passage 93*a*. As shown in FIG. 2, FIG. 3A, and FIG. 3B, the communicating fluid passage 96 is constituted of a fluid passage (or a fluid tube) configured to be connected to the pressure-receiving portion 92 and the inner fluid passage 93*a* and thereby to communicate with the pressure-receiving portion 92 and the inner fluid passage 93*a*, the pressure-receiving portion 92 being disposed on one side (one side in the longitudinal direction) of the spool 91, the inner fluid passage 93*a* being disposed on the other side (the other side in the longitudinal direction) of the spool 91.

Specifically, the communicating fluid passage 96 includes a first communicating passage 96*a*, a second communicating passage 96*b*, and a third communicating passage 96*c*. The first communicating passage 96*a* extends radially from the center of an outer surface (a lateral surface) of the spool 91, the outer surface being on one end side of the spool 91. The second communicating passage 96*b* communicates with the first communicating passage 96*a* and extends from the one side of the spool 91 to the other side in the interior of the spool 91. The third communicating passage 96*c* communicates with the second communicating passage 96*a* and radially extends in the interior of the spool 91.

One or more of the first communicating passages 96*a* are provided. One or more of the first communicating passages 96*a* communicate with the second communicating passage 96*b* on one end side (an inner diameter side) of the first communicating passages 96*a*, and the other end side (the outer diameter side) of the first communicating passages 96*a* reaches an outer circumference surface of the spool 91. The first communicating passage 96*a* is constituted of a groove formed to have a U-shape, a V-shape, a channel shape, or the like on the side surface of the spool 91.

Figure 4A:
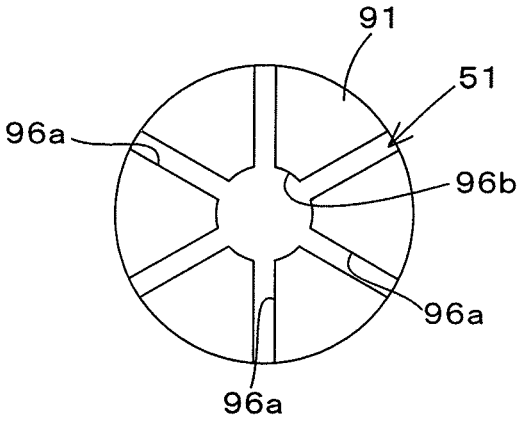
FIG. 4A is a side view of the spool, the side view illustrating details of a first communicating passage according to the first embodiment.
Figure 4B:
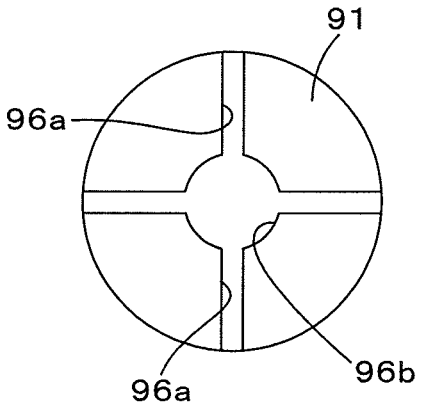
FIG. 4B is a side view of the spool, the side view illustrating details of the first communicating passage according to the first embodiment.
Figure 4C:
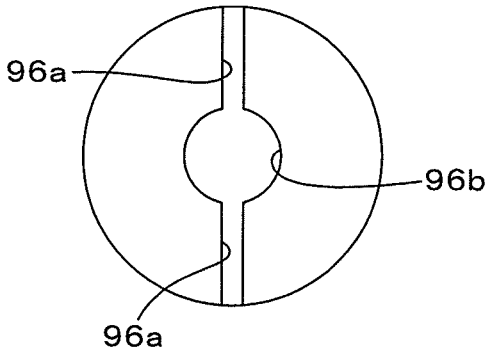
FIG. 4C is a side view of the spool, the side view illustrating details of the first communicating passage according to the first embodiment.

As shown in FIG. 4A to FIG. 4C, when provided are a plurality of the first communicating passages 96*a*, the plurality of first communicating passages 96*a* are arranged to be equally spaced in the circumferential direction of the spool 91 (every 60 deg., every 45 deg., or every 90 deg.). That is, the plurality of first communicating passages 96*a* are arranged in the line symmetry with respect to a straight line passing through the center of the spool 91. Meanwhile, the number of the first communicating passages 96*a* may be an odd number such as one, three, or the like.

The second communicating passage 96*b* extends passing through the center (the cross-sectional center) of the spool 91 in the longitudinal direction. One end of the second communicating passage 96*b* communicates with the first communicating passage 96*a*. The other end of the second communicating passage 96*b* extends to a position corresponding to the second connecting portion 91*b*.

Figure 4D:
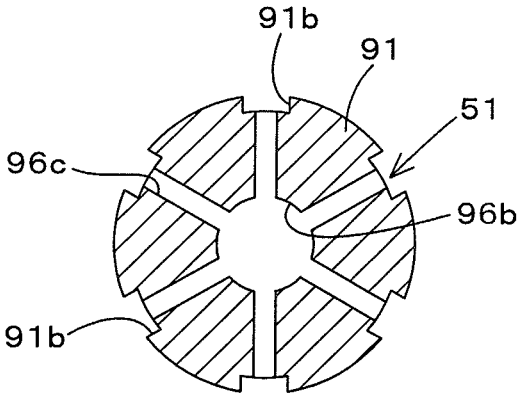
FIG. 4D is a side view of the spool, the side view illustrating details of a third communicating passage according to the first embodiment.
Figure 4E:
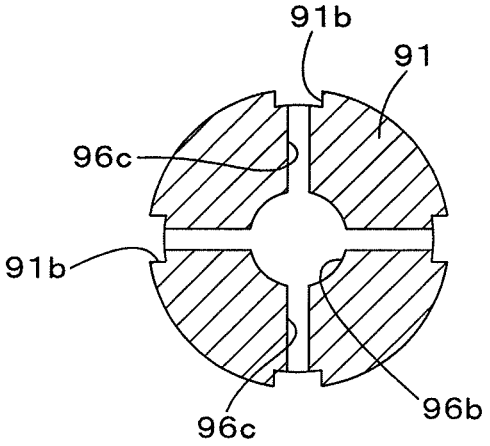
FIG. 4E is a side view of the spool, the side view illustrating details of the third communicating passage according to the first embodiment.
Figure 4F:
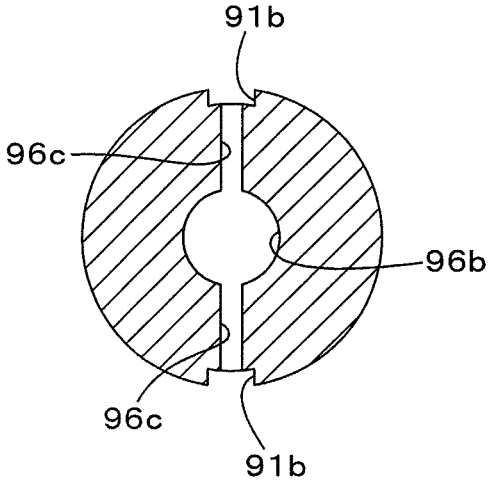
FIG. 4F is a side view of the spool, the side view illustrating details of the third communicating passage according to the first embodiment.

One or more of the third communicating passages 96*c* are provided. One or more of the third communicating passages 96*c* communicate with the second communicating passage 96*b* on one end side (the inner diameter side) of the third communicating passages 96*c*, and the other end side (the outer diameter side) of the third communicating passages 96*c* reaches the outer circumference surface of the spool 91 and communicates with the second connecting portion 91*b*. Meanwhile, as shown in FIG. 4D to FIG. 4F, when provided are a plurality of the third communicating passages 96*c*, the plurality of third communicating passages 96*c* are arranged to be equally spaced in the circumferential direction of the spool 91 (every 60 deg., every 45 deg., or every 90 deg.). That is, the plurality of third communicating passages 96*c* are arranged in the line symmetry with respect to a straight line passing through the center of the spool 91.

As shown in FIG. 2, the third communicating passage 96*c* communicates with a fourth communicating passage 96*d*, the fourth communicating passage 96*d* communicating with the a housing chamber configured to house the biasing member 95. The fourth communicating passage 96*d* is constituted of an fluid tube configured to guide the hydraulic fluid to the third communication passage 96*c*, the hydraulic fluid being accumulated in the housing chamber.

As described above, when the second switching valve 72 is switched to the second position 72*b*, the pilot fluid outputted from the third hydraulic pump P3 is supplied to the pressure-receiving portion 92 (the pressure-receiving chamber 92*b*) of the first switching valve 71 through the second pilot fluid tube 46 and the first pilot fluid tube 49. At this time, as shown in FIG. 3B, a part of the pilot fluid supplied to the pressure-receiving chamber 92 is guided to the communicating passage 96*b* by the first communicating passage 96*a*, and the operation fluid introduced into the second communicating passage 96*b* passes through the third communicating passage 96*c* and is outputted to the first inner fluid passage 93*a* and to the outputting fluid tube (the third port 71C and the fourth port 71D).

In this manner, the speed of the spool 91 moving from the first position 71*a* to the second position 72*b* is reduced, and thereby the shock generated by the first switching valve 71 is reduced in increasing the flow rate of the operation fluid. That is, by only changing the shape of the spool 91, it is possible to reduce the shock of the first switching valve 71 in increasing the flow rate of the hydraulic fluid, and thus the number of parts is reduced as compared with the prior art.

Second Embodiment

Figure 5A:
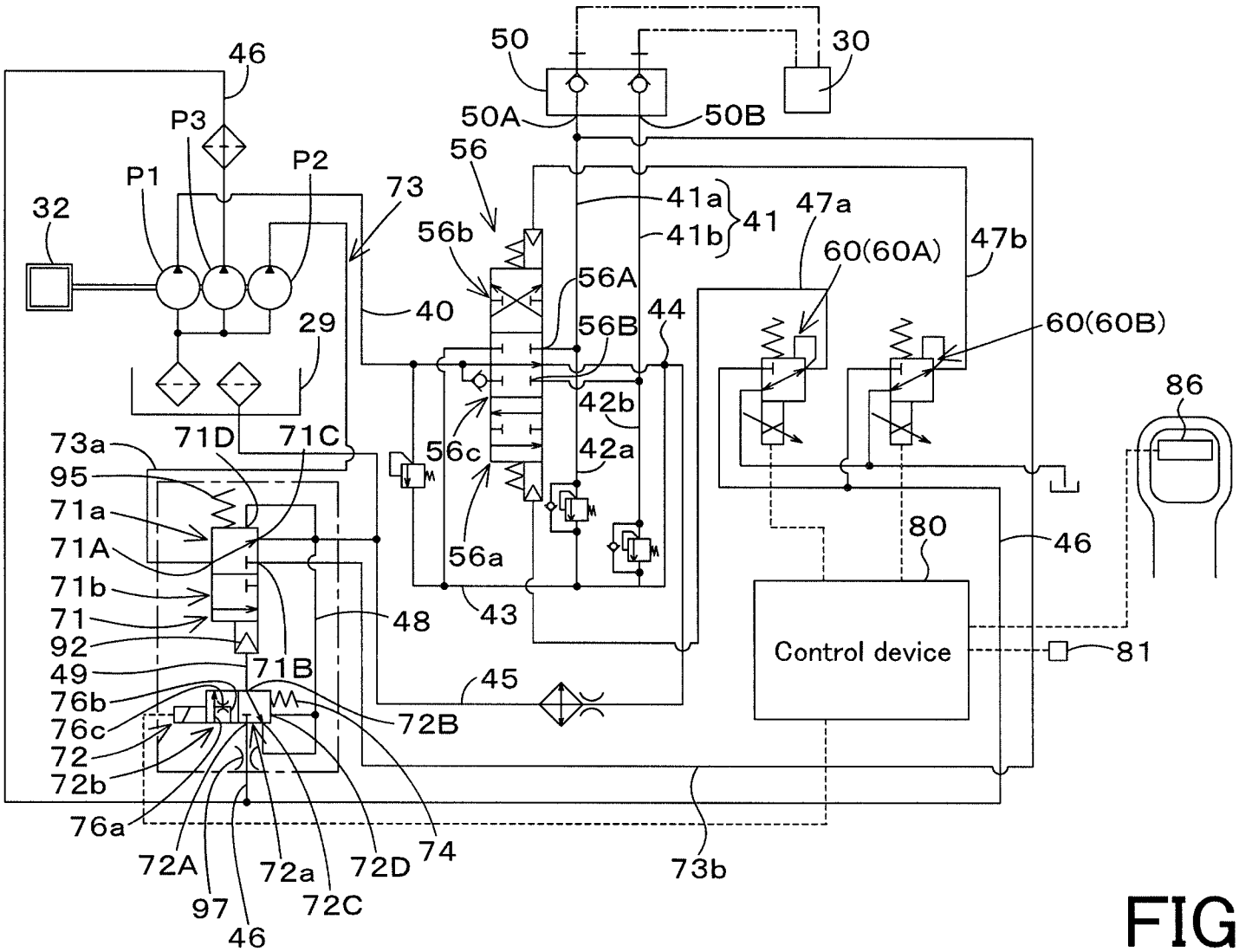
FIG. 5A is a view illustrating a hydraulic system for a working machine according to a second embodiment of the present invention.

FIG. 5A shows a hydraulic system according to a second embodiment of the present invention. The second embodiment will mainly describes a configuration different from the configuration of the first embodiment. In the second embodiment, the communicating fluid passage 96 described in the first embodiment is not disposed on the spool 91 of the first switching valve 71, but instead the second switching valve 72 is modified to reduce the shock of the first switching valve 71 in the increasing of the flow rate of the hydraulic fluid.

Specifically, the second switching valve 72 has a fifth inner fluid passage 76*a*, a sixth inner fluid passage 76*b*, and a throttling portion 76*c*. The fifth inner fluid passage 76*a* is constituted of an fluid tube, the fluid tube being formed in the main body of the second switching valve 72 and configured to connect the first port 72A and the second port 72B to each other in the second position 72*b*. In addition, the sixth inner fluid passage 76*b* is constituted of an fluid tube formed in the main body of the second switching valve 72, the fluid tube communicating with the fifth inner fluid passage 76*a* at the second position 72*b* and communicating with the third port (the exhaust port) 72C. The throttling portion 76*c* is disposed on an intermediate portion of the sixth inner fluid passage 76*b*, and thereby reduces the hydraulic fluid.

The throttling portion 76*c* may be configured by making the inner diameter of a part of the sixth inner flow path 76*b* smaller than the inner diameter of the other portion of the sixth inner flow path 76*b*, by providing a member having a different diameter on the sixth internal fluid tube 76*b*, or by other methods. Additionally, in the second pilot fluid tube 46, a throttling portion 97 is disposed in the vicinity of the first port 72A of the second switching valve 72, the throttling portion 97 being configured to reduce the flow rate of the pilot fluid.

As described above, when the second switching valve 72 is set to the second position 72*b*, the pilot fluid introduced from the first port 72A flows from the second port 72B to the pilot fluid tube 49 through the fifth inner fluid passage 76*a*. At this time, a part of the pilot fluid passing through the fifth inner fluid passage 76*a* passes through the sixth inner fluid passage 76*b* and is outputted from the third port 72C to the outputting fluid tube 48. In this manner, the pressure of the pilot fluid applied to the pressure-receiving portion 92 (the pressure-receiving chamber 92*b*) of the first operation valve 71 is reduced, and thus the shock generated by the first switching valve 71 is reduced in increasing the flow rate of the operation fluid.

Figure 5B:
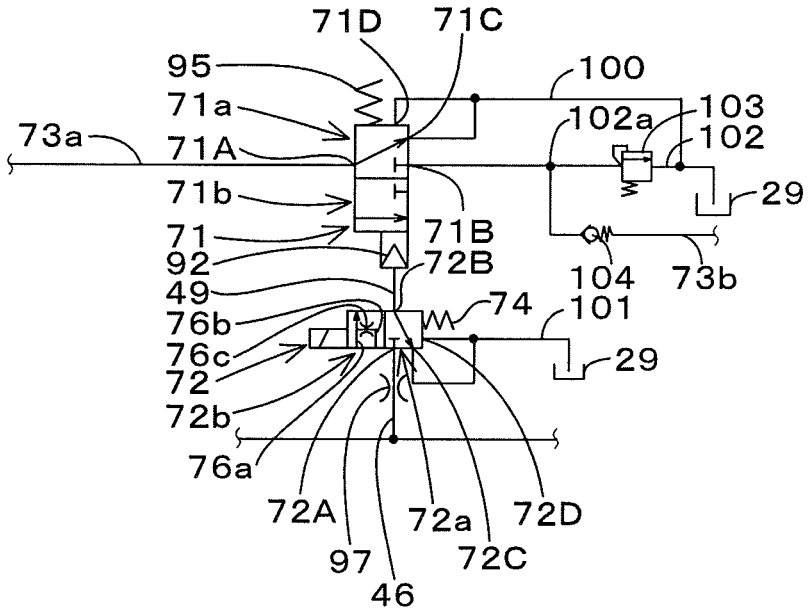
FIG. 5B is a view illustrating a first modified example of the hydraulic system for the working machine according to the embodiments.
Figure 5C:
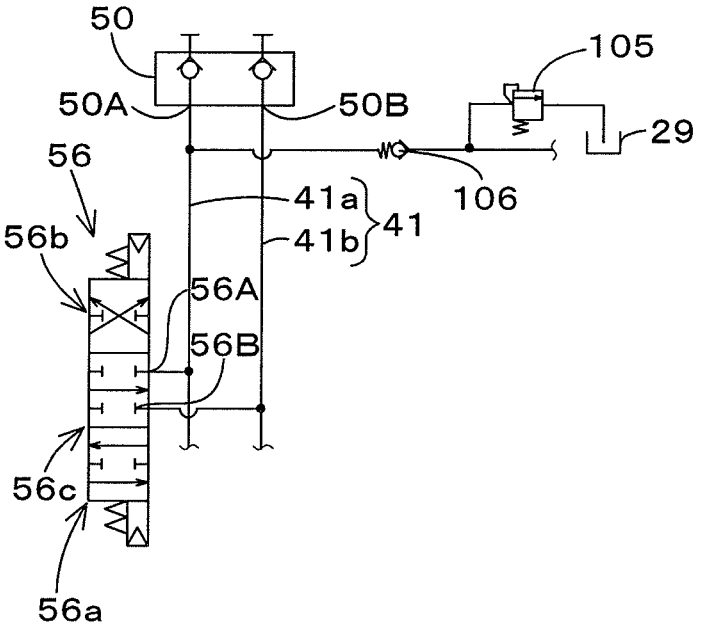
FIG. 5C is a view illustrating a second modified example of the hydraulic system for the working machine according to the embodiments.
Figure 5D:
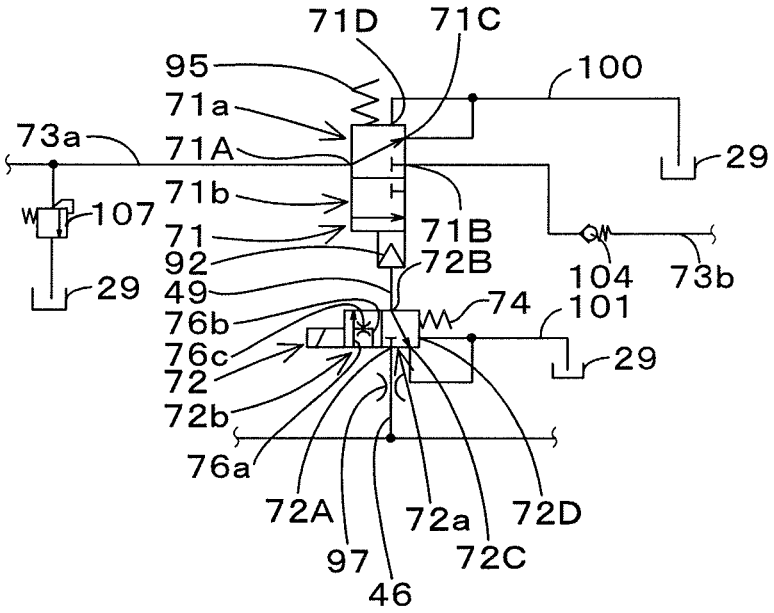
FIG. 5D is a view illustrating a third modified example of the hydraulic system for the working machine according to the embodiments.

FIG. 5B, FIG. 5C, and FIG. 5D show modified examples of the above-described embodiments.

FIG. 5B shows a hydraulic system (a hydraulic circuit) in which the outputting fluid tubes of the first switching valve 71 and the second switching valve 72 are separately provided. As shown in FIG. 5B, an outputting fluid tube 100 is connected to the third port 71C of the first switching valve 71 and to the fourth port 71D of the first switching valve 71. And, an outputting fluid tube 101 is connected to the third port 72C of the second switching valve 72 and the fourth port 72D of the second switching valve 72.

In addition, an outputting fluid tube 102 is connected to an intermediate portion of the second increasing fluid tube 73*b*. The outputting fluid tube 102 is connected to the outputting fluid tube 100, and a relief valve 103 is connected to an intermediate portion of the outputting fluid tube 102. Further, in the second increasing fluid tube 73*b*, a check valve 104 is connected to a portion closer to the first fluid tube 41 side (the downstream side) than a connecting portion w102*a* to which the outputted fluid tube 102 is connected. A check valve 104 allows the operation fluid to flow from the second fluid tube 73 to the first fluid tube 41, and blocks the hydraulic fluid from flowing from the first fluid tube 41 to the second fluid tube 73.

FIG. 5C shows a hydraulic system (a hydraulic circuit) in which a relief valve 105 is disposed on the second increasing fluid tube 73*b*. As shown in FIG. 5C, the second increasing fluid tube 73*b* of the second fluid tube 73 is, for example, branched in an intermediate portion of the second increasing fluid tube 73*b*, and the relief valve 105 is disposed on the branched fluid tube of the second increasing fluid tube 73*b*. Meanwhile, a check valve 106 may be disposed on the second increasing fluid tube 73*b* of the second fluid tube 73. The check valve 106 allows the operation fluid to flow from the second fluid tube 73 to the first fluid tube 41 and blocks the hydraulic fluid from flowing from the first fluid tube 41 to the second fluid tube 73.

FIG. 5D shows a hydraulic system (a hydraulic circuit) in which a relief valve 107 is disposed on the first increasing fluid tube 73*a*. As shown in FIG. 5D, the first increasing fluid tube 73*a* of the second fluid tube 73 is, for example, branched in an intermediate portion of the first increasing fluid tube 73*a*, and the relief valve 107 is disposed on the branched fluid tube of the first increasing fluid tube 73*a*. Meanwhile, as shown in FIG. 5C and FIG. 5D, a relief valve is disposed on either one of the first increasing fluid tube 73*a* and the second increasing fluid tube 73*b*.

Figure 8:
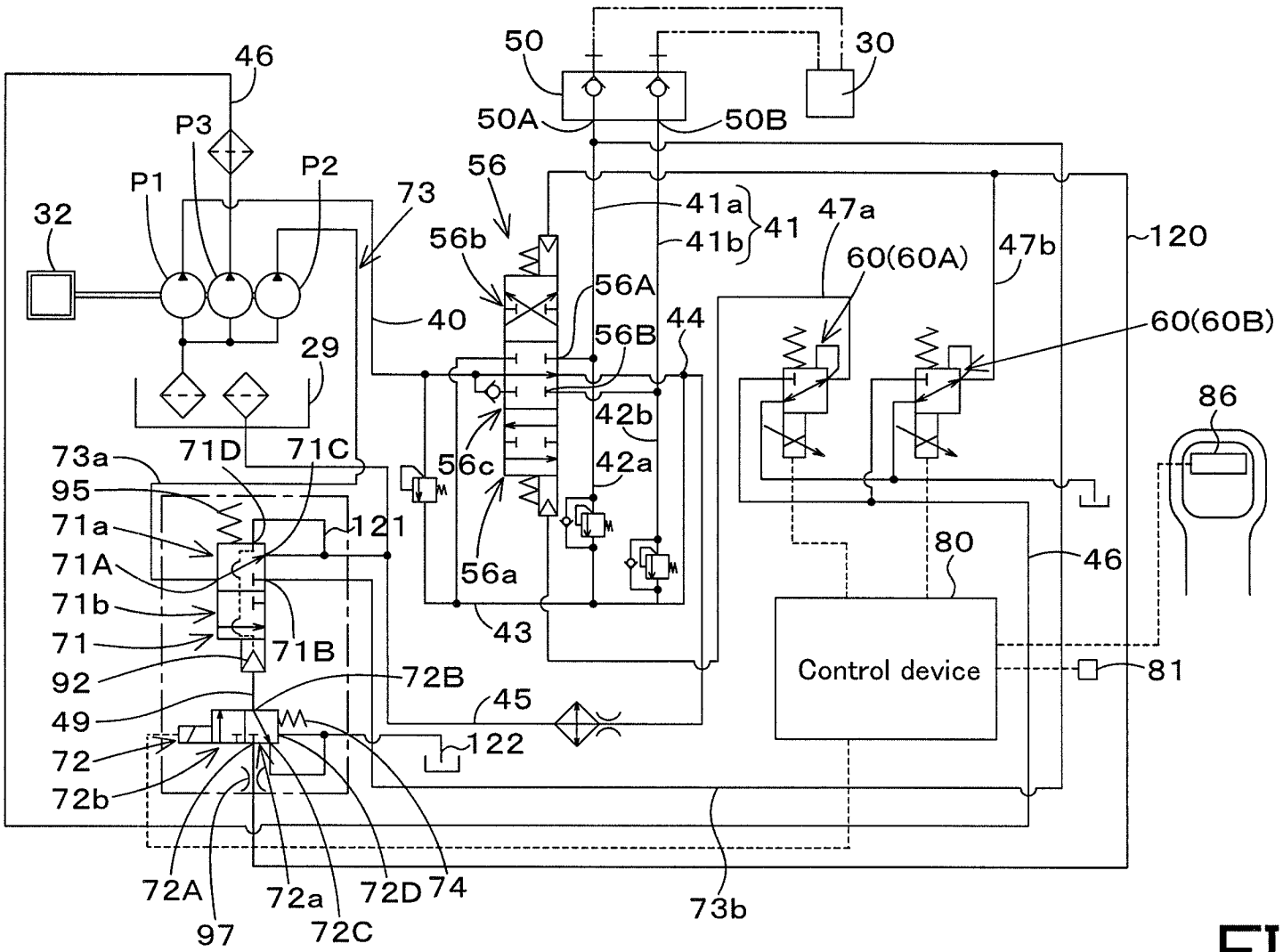
FIG. 8 is a view illustrating a fourth modified example of the hydraulic system for the working machine according to the embodiments.
Figure 9:
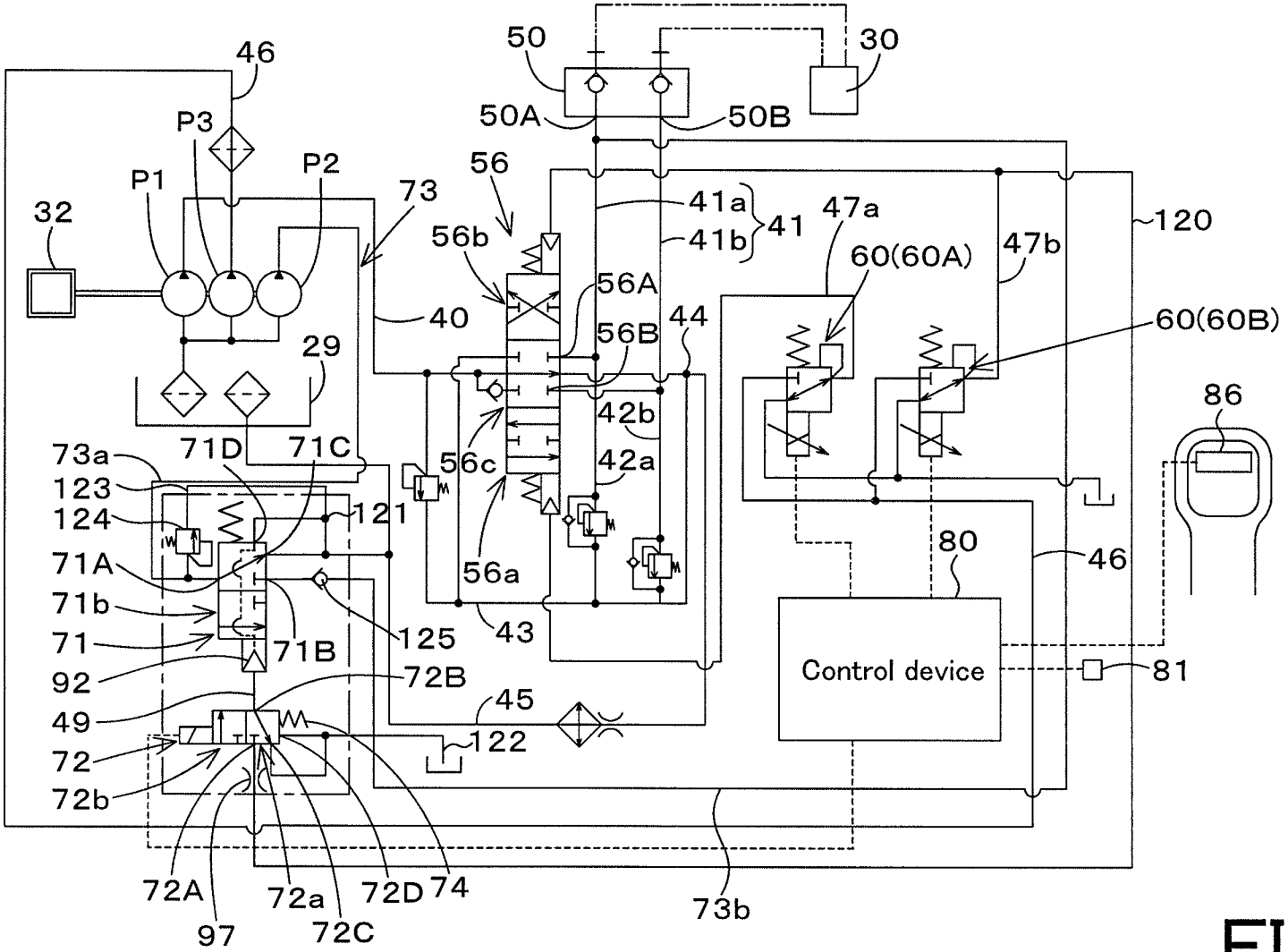
FIG. 9 is a view illustrating a fifth modified example of the hydraulic system for the working machine according to the embodiments.
Figure 10:
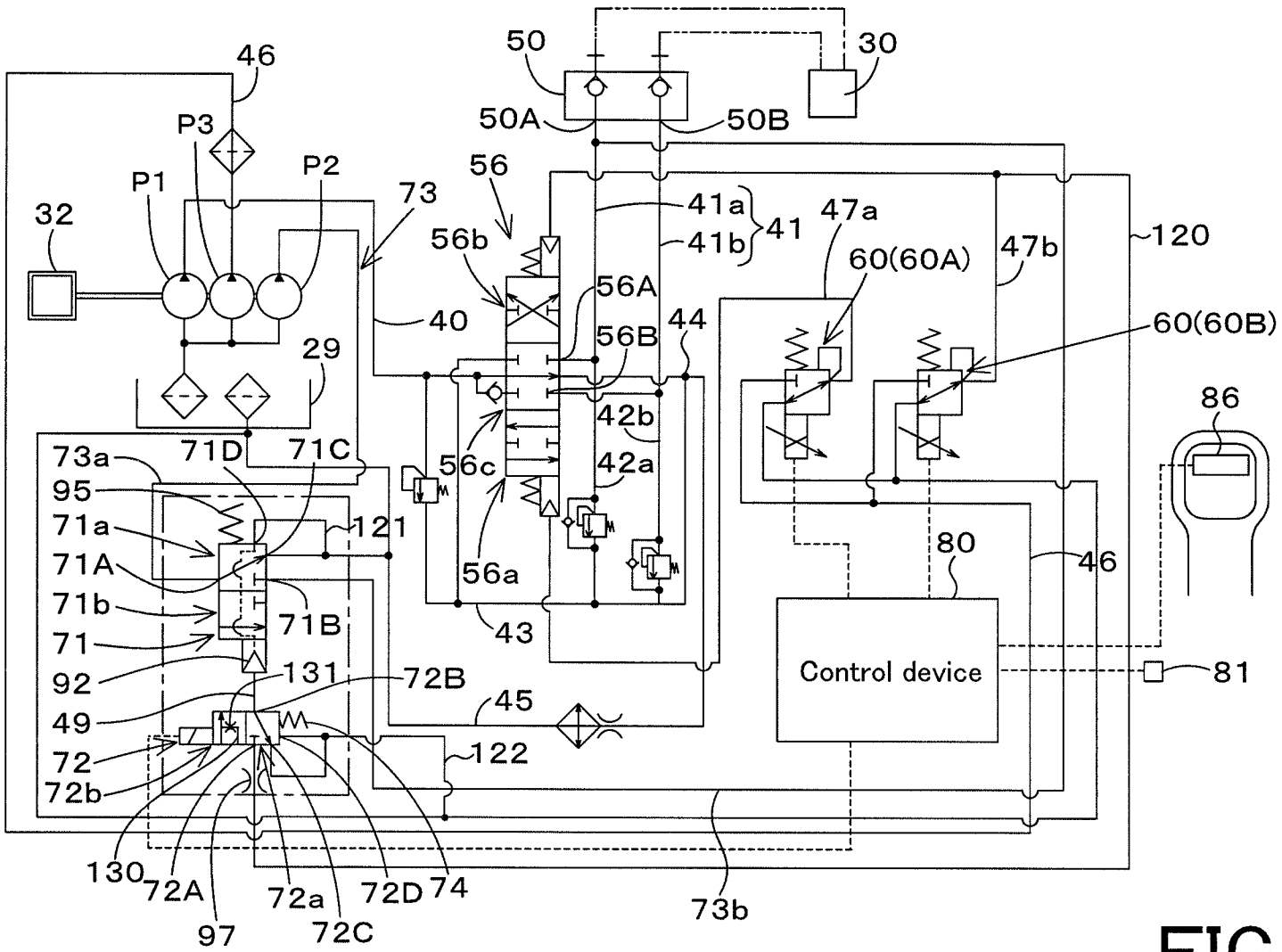
FIG. 10 is a view illustrating a sixth modified example of the hydraulic system for the working machine according to the embodiments.

FIG. 8 to FIG. 10 show modified examples of the above-described embodiments.

As shown in FIG. 8, a fluid tube 120 is connected to the fluid tube 47*b* configured to connect the pressure receiving portion of the control valve 56 to the second proportional valve 60B. In addition, the fluid tube 120 is connected to the first port 72A of the second switching valve 72. A second throttling portion 97 is disposed on an intermediate portion of the fluid tube 120. In addition, an outputting fluid tube 121 is connected to the fourth port 71D of the first switching valve 71. An outputting fluid tube 122 is connected to the fourth port 72D of the second switching valve 72.

As shown in FIG. 9, a hydraulic system (a hydraulic circuit) is provided with an fluid tube 120, an outputting fluid tube 121, and an outputting fluid tube 122 in the similar manner shown in FIG. 8. In addition, a bypass fluid tube 123 is connected to the outputting fluid tube 121 and to the first increasing fluid tube 73*a*, and a relief valve 124 is connected to the bypass fluid tube 123. The second increasing fluid tube 73*b* is provided with a check valve 125 configured to allow the operation fluid to flow from the second port 71B of the first switching valve 71 to the first fluid tube 41*a* and to block the hydraulic fluid from flowing from the first fluid tube 41*a* to the second port 71B.

As shown in FIG. 10, a hydraulic system (a hydraulic circuit) is provided with an fluid tube 120, an outputting fluid tube 121, and an outputting fluid tube 122 in the similar manner shown in FIG. 8. A fluid tube 130 is connected to the inside of the second switching valve 72, the fluid tube 130 connecting the first port 72A to the third port 72C under the state where the second switching valve 72 is in the second position 72*b*. A throttling portion 131 is connected to the fluid tube 130.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In the embodiments described above, the output destination of the operation fluid is the operation fluid tank 29. However, any portion (any configuration) configured to adequately output the operation fluid may be employed. For example, that portion may be a suction portion of the hydraulic pump or another portion may be employed.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system for a working machine, comprising:
- a hydraulic actuator to be operated by an operation fluid;
- a first hydraulic pump to output the operation fluid;
- a second hydraulic pump to output the operation fluid;
- a control valve to which the operation fluid outputted from the first hydraulic pump is supplied, the control valve being configured to control the operation fluid that is to be supplied to the hydraulic actuator;
- a first fluid tube connecting the control valve to the hydraulic actuator;
- a second fluid tube to which the operation fluid outputted from the second hydraulic pump is supplied, the second fluid tube being connected to the first fluid tube; and
- a first switching valve disposed on the second fluid tube, the first switching valve including:
  - a pressure-receiving port to receive a pressure of the operation fluid;
  - a first inner fluid passage to output the operation fluid; and
  - a spool to move between a first position and a second position due to the operation fluid applied to the pressure-receiving port,
    - the first position to block the operation fluid from being supplied to the first fluid tube,
    - the second position to supply the operation fluid to the first fluid tube,
  - the spool including
    - a communicating fluid passage being configured to supply the operation fluid to the first inner fluid passage, the operation fluid being received by the pressure-receiving port,
- wherein the pressure-receiving port is arranged on one side of the spool in a longitudinal direction of the spool,
- wherein the first inner fluid passage is arranged on the other side opposite to the one side of the spool in a longitudinal direction of the spool,
- and wherein the communicating fluid passage extends, inside the spool, from the one side of the spool to the other side.

2. The hydraulic system for the working machine according to claim 1, comprising:
- a pilot fluid tube connected to the pressure-receiving port; and
- a second switching valve to be switched between a first position and a second position,
  - the first position to supply the operation fluid to the pilot fluid tube, the second position to block the operation fluid from being supplied to the pilot fluid tube.

3. The hydraulic system for the working machine according to claim 1, wherein the second fluid tube includes:

a first increasing fluid tube to connect the second hydraulic pump to the first switching valve; and a second increasing fluid tube to connect the first switching valve to the first fluid tube;

wherein the first switching valve includes:

a second inner fluid passage to which the operation fluid of the first increasing fluid tube is supplied;

a third inner fluid passage to supply the operation fluid to the second increasing fluid tube, the operation fluid being supplied to the second inner fluid passage; and a fourth inner fluid passage to communicate with the second inner fluid passage and the first inner fluid passage, and wherein the spool is configured to open the fourth inner fluid passage when the spool is in the first position and to close the fourth inner fluid passage when the spool is in the second position.

4. A hydraulic system for a working machine, comprising:

a hydraulic actuator to be operated by an operation fluid;

a first hydraulic pump to output the operation fluid;

a second hydraulic pump to output the operation fluid;

a control valve to which the operation fluid outputted from the first hydraulic pump is supplied, the control valve being configured to control the operation fluid that is to be supplied to the hydraulic actuator;

a first fluid tube connecting the control valve to the hydraulic actuator;

a second fluid tube to which the operation fluid outputted from the second hydraulic pump is supplied, the second fluid tube being connected to the first fluid tube;

a first switching valve disposed on the second fluid tube, the first switching valve including:

a pressure-receiving port to receive a pressure of the operation fluid; and a spool to move between a first position and a second position due to the operation fluid applied to the pressure-receiving port, the first position to block the operation fluid from being supplied to the first fluid tube, the second position to supply the operation fluid to the first fluid tube;

a first pilot fluid tube connected to the pressure-receiving port of the first switching valve; and a second switching valve including:

a first port to which the operation is supplied;

a second port connected to the pilot fluid tube;

an outputting port to output the operation fluid;

a spool to move between a first position and a second position;

a fifth inner fluid passage to connect the first port to the second port when the spool is in the first position; and a sixth inner fluid passage connected to the fifth inner fluid passage and connected to the outputting port, wherein the outputting port is connected to an operation fluid tank that is an output destination of the operation fluid, the second switching valve connects the second port and the outputting port when the spool of the second switching valve is in the first position, and allows the operation fluid in the fifth inner fluid passage to flow through the sixth inner fluid passage and the outputting port and to be discharged when the spool of the second switching valve is in the second position.

5. The hydraulic system for the working machine according to claim 4, comprising a first throttling portion disposed on the sixth inner fluid passage.

6. The hydraulic system for the working machine according to claim 4, comprising:

a second pilot fluid tube to supply the operation fluid to the first port; and a second throttling portion disposed on the second pilot fluid tube.

* * * * *